US005384739A

United States Patent [19]

Keeth

[11] Patent Number: 5,384,739

[45] Date of Patent: Jan. 24, 1995

[54] SUMMING CIRCUIT WITH BIASED INPUTS AND AN UNBIASED OUTPUT

[75] Inventor: Brent Keeth, Boise, Id.

[73] Assignee: Micron Semiconductor, Inc., Boise, Id.

[21] Appl. No.: 76,073

[22] Filed: Jun. 10, 1993

[51] Int. Cl.[6] ..... G05F 3/16

[52] U.S. Cl. ..... 365/189.09; 323/313; 323/314; 327/361; 327/530; 327/540

[58] Field of Search ..... 365/189.09; 323/312, 323/313, 314, 315, 907, 281; 307/296.1, 296.6, 296.7

[56] References Cited

U.S. PATENT DOCUMENTS

| | | | |
|---|---|---|---|
| 4,928,056 | 5/1990 | Pease | 323/314 |
| 5,119,015 | 6/1992 | Watanabe | 323/313 |
| 5,229,710 | 7/1993 | Kraus et al. | 307/296.1 |

OTHER PUBLICATIONS

Kuijk, Karel E., "A precision Reference Voltage Source," Jun. 1973, IEEE Journal of Solid State Circuits, vol. SC-6 No. 3, pp. 222-226.

Vittoz, Eric A., "A Low-Voltage CMOS Bandgap Reference," Jun. 1979, IEEE Journal of Solid State Circuits, vol. SC-14, No. 3, pp. 573-577.

Ye R. and Tsividis, Y., "Bandgap Voltage Reference Sources in CMOS Technology," Electronic Letters Jan. 7, 1982 vol. 18 No. 1 pp. 24-25.

Michajda, John and Kim, Suk K., "A Precision CMOS Bandgap Reference," Dec. 1984, IEEE Journal of Solid State Circuits, vol. SC-19 No. 6, pp. 1014-1021.

Meijer, Gerard C. M., and Verhoeff, Jan B., "An Integrated Bandgap Reference," Jun. 1976, IEEE Journal of Solid State Circuits, Correspondence pp. 403-406.

*Primary Examiner*—Eugene R. LaRoche
*Assistant Examiner*—Vu Le
*Attorney, Agent, or Firm*—William R. Bachand

[57] ABSTRACT

A band gap voltage reference circuit operates between a positive supply voltage and ground. The inputs to a difference amplifier of the band gap reference circuit are biased above the voltage drop of the base-emitter junctions of the band gap reference. The bias voltage is then subtracted from the difference amplifier output by a second difference amplifier. In addition, a bootstrap circuit assures a nonzero output from the first difference amplifier. Other embodiments wherein the band gap reference circuit is more generally a summing circuit are disclosed.

19 Claims, 5 Drawing Sheets

SUMMING CIRCUIT WITH BIASED INPUTS AND AN UNBIASED OUTPUT

TECHNICAL FIELD

The invention relates to integrated circuits and particularly circuits that provide an output corresponding to the sum of signals input to the circuit.

BACKGROUND

The input stage of an operational amplifier is, conventionally, a difference amplifier. The operational amplifier is a building block for instrumentation, analog control, and voltage regulation applications, to name a few. In a wide variety of applications, difference amplifiers are powered between voltage sources of opposite polarity. In operation, two input signals are connected to a difference amplifier for controlling the current flow through one of a symmetric pair of transistors. The pair of transistors are connected to a common current source, conventionally powered from the negative power supply. If the two input signals are within the allowable input voltage range, then a signal taken at the collector of one of the pair of transistors forms the output signal.

The voltage of the output signal corresponds to the difference in voltage of the input signals. When the input signals are not within the input voltage range of the difference amplifier, the output signal no longer corresponds to the difference in input voltages. When the difference amplifier is powered between supplies of equal and opposite polarity, the input signal range extends from a negative voltage through ground to a positive voltage.

Digital integrated circuits including logic circuits, microprocessors, and memory circuits, are conventionally powered between a single voltage source and ground. When a difference amplifier is operated between a single voltage source and ground, the input signal range does not include voltages near ground potential, but extends around a voltage of half the power supply voltage.

In many applications where a difference amplifier would be useful, supply voltages of opposite polarity are arranged as a prerequisite so that input signals near ground can be connected to the difference amplifier inputs. Such an arrangement is difficult in digital integrated circuits. A negative power supply voltage that is stable, invariant to temperature, and capable of supplying necessary current is difficult to design, occupies space on an otherwise digital integrated circuit substrate, and usually requires decoupling techniques to counteract the effects of noise generated by the digital circuitry.

Thus, there remains a need for a difference amplifier circuit operable between a single power supply and ground that can provide a difference voltage output signal when input signals have voltages near ground. The need is especially apparent in digital integrated circuit applications where use of a negative power supply is costly and temperature compensation of the difference amplifier output signal is important.

SUMMARY

Accordingly, an integrated circuit in one embodiment of the present invention includes a summing circuit, a first and second voltage reference, and a subtraction circuit. The summing circuit responds to a plurality of input signals to form a sum signal corresponding to the algebraic sum of all input signals. In an algebraic sum, negative input signals tend to cancel positive input signals. The first voltage reference is coupled to at least one input of the summing circuit so that the output of the summing circuit will not remain at zero after power is applied. The second voltage reference is coupled to each summing circuit input to bias each input into the allowable input signal range of the summing circuit. The subtraction circuit responds to the sum signal and to the second reference voltage to subtract the second voltage from the sum signal. The output of the subtraction circuit is, therefore, the sum of the input signals.

According to a first aspect of such an integrated circuit, by combining the second reference voltage with a summing circuit input signal, an input signal having a voltage near ground appears to the summing circuit as a signal within the allowable input signal range and the output sum signal is valid.

According to another aspect, a band gap reference circuit employs a summing circuit in one embodiment of the present invention so that a temperature compensated stable voltage reference for a digital integrated circuit is powered between a single power supply voltage and ground.

According to another aspect, the summing circuit includes a difference amplifier. A low voltage signal input to the summing circuit will not have the effect of shutting off the current source in the common leg of the difference amplifier. This result follows from combining the second reference voltage with the input of the summing circuit.

According to yet another aspect of the present invention, a summing circuit, subject to common mode signals that would otherwise saturate a difference amplifier, can operate in a linear region when the second reference voltage is selected to subtract from the common mode signal.

According to another aspect, a summing circuit that responds to feedback signals derived from its sum signal output will, after power up, develop a nonzero output signal in response to the first reference signal.

According to another aspect, the first reference signal is decoupled from the summing circuit when the sum signal is nonzero to reduce power consumption.

According to another aspect, the summing circuit supports low power applications where input signals are near ground and power conservation is critical.

According to still another aspect, a difference amplifier of the summing circuit and a difference amplifier of the subtraction circuit employ current mirrors controlled by the second reference voltage for accurate provision of the difference output signal.

The present invention may be practiced according to a method which in one embodiment includes the steps of: coupling a first source to an input of a summing circuit so that the output of the first source is combined with an input signal for the summing circuit; decoupling the first source from the summing circuit when a nonzero sum signal is provided; coupling a second source to each input of the summing circuit so that the output of the second source is combined with each input signal for the summing circuit; and subtracting the output of the second source from the sum signal.

According to one aspect of such a method, a sum signal is produced from signals having voltages outside the input signal voltage range of a difference amplifier that is operated between a single supply and ground.

These and other embodiments, aspects, advantages, and features of the present invention will be set forth in part in the description which follows, and in part will become apparent to those skilled in the art by reference to the following description of the invention and referenced drawings or by practice of the invention. The aspects, advantages, and features of the invention are realized and attained by means of the instrumentalities, procedures, and combinations particularly pointed out in the appended claims.

In each functional block diagram, a group of signals is shown as a single line, sometimes with an arrow to indicate a flow of control. A single line between functional blocks represents that the blocks are coupled and that one or more signals are conveyed between the blocks at various times.

Signals that appear on several Figures and have the same mnemonic are directly or indirectly coupled together. A signal named with a mnemonic and a second signal named with the same mnemonic followed by an asterisk are related by logic inversion.

DESCRIPTION

Figure 1:
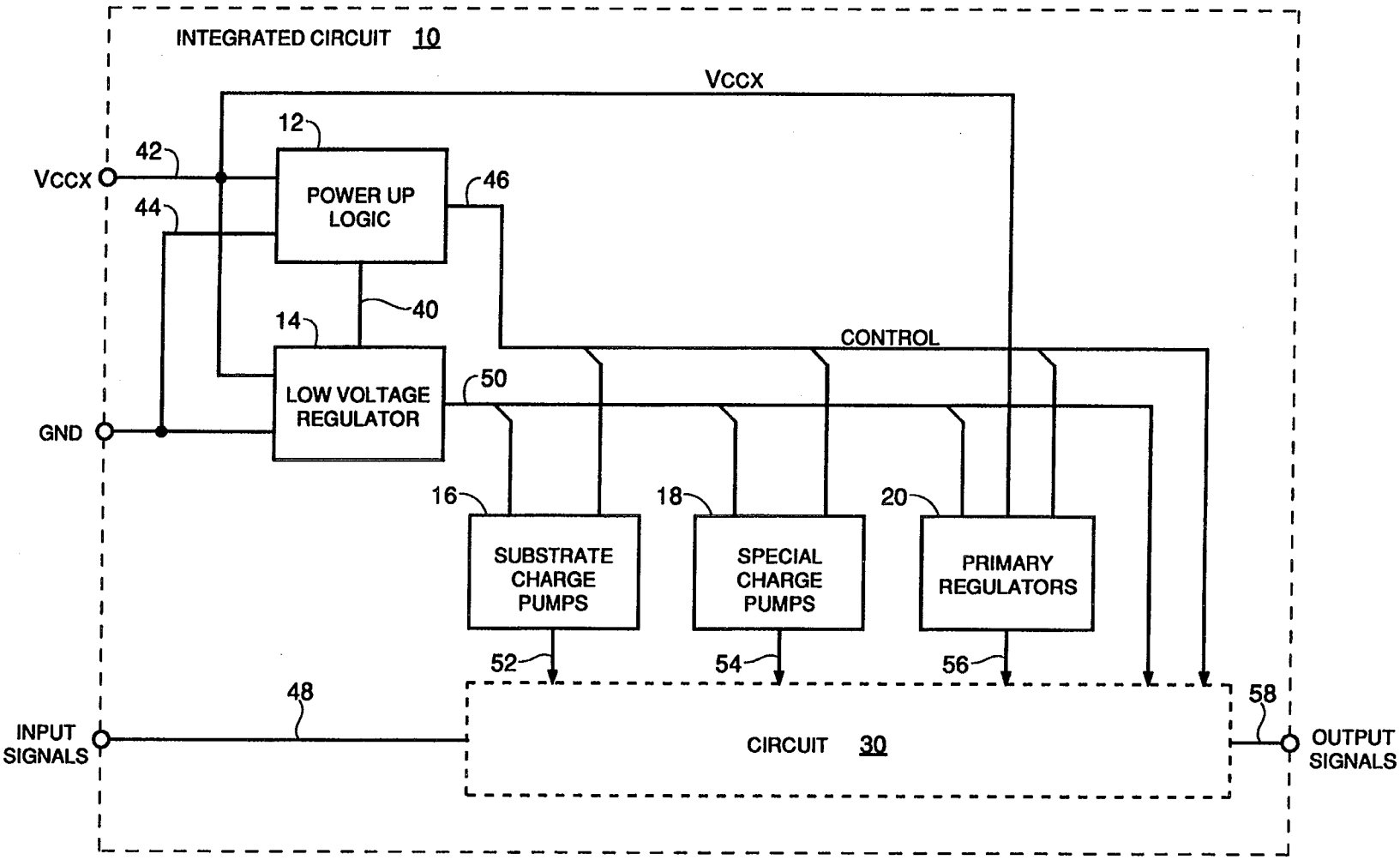
FIG. 1 is a functional block diagram of an integrated circuit in one embodiment of the present invention.

FIG. 1 is a block diagram of an integrated circuit of the present invention. Integrated circuit 10 is an integrated circuit having conventional electrical circuit functions shown generally as circuit 30, and connections for power signals 42 (VCCX), ground conductor 44 (GND), at least one input shown generally as input signal 48 and at least one output shown generally as output signal 58. Output signal 58 is not necessary and may be deleted when the function of circuit 30 does not require provision of an output signal. As shown, circuit 30 uses power and control signals for initialization and operation.

Power signals provided to circuit 30 are derived from power signals 42. When circuit 30 requires multiple power signals for operation, integrated circuit 10 includes low voltage regulator 14 and primary regulators 20. Low voltage regulator 14 provides intermediate power signals 50, coupled as required to substrate charge pumps 16, special charge pumps 18, and primary regulators 20. Substrate charge pumps 16 provide power signals 52 coupled to circuit 30. Special charge pumps 18 provide power signals 54 coupled to circuit 30. Primary regulators 20 provide power signals 56 coupled to circuit 30. When circuit 30 requires fewer power signals for operation, intermediate power signals 50 may be simplified and related circuit simplifications may be employed as is well known in the art.

Low voltage regulator 14 receives power and control signals 40 provided by power up logic 12. In alternate and equivalent embodiments, regulator 14 regulates elevated voltages or currents. Control signals 40 enable and govern the operation of low voltage regulator 14. Similarly control signals 46, provided by power up logic 12 enable and govern the operation of substrate charge pumps 16, special charge pumps 18, and primary regulators 20. The sequence of enablement of these several functional blocks depends on the circuitry of each functional block and upon the power signal sequence requirements of circuit 30.

Circuit 30 in various embodiments is an analog circuit, a digital circuit, or a combination of analog and digital circuitry. Although the present invention is effectively applied where circuit 30 includes dynamic memory (DRAM) or a video memory (VRAM) having a serial port, the present invention can be beneficially and equivalently applied by a person of ordinary skill to integrated circuits in general, whether or not the integrated circuit is powered from a single power supply potential. The conventional dynamic memory includes an array of storage cells. In a memory of the present invention, accessing the array for read, write, or refresh operations is accomplished with circuitry powered by voltages having magnitudes different from the voltage magnitude of signal VCCX. These additional voltages are developed from a voltage reference circuit to be described.

Power to be applied to circuit 30 is conventionally regulated to permit use of integrated circuit 10 in systems providing power that is insufficiently regulated for proper operation of circuit 30. Low voltage regulator 14 includes a summing circuit to be described in detail below.

Figure 2:
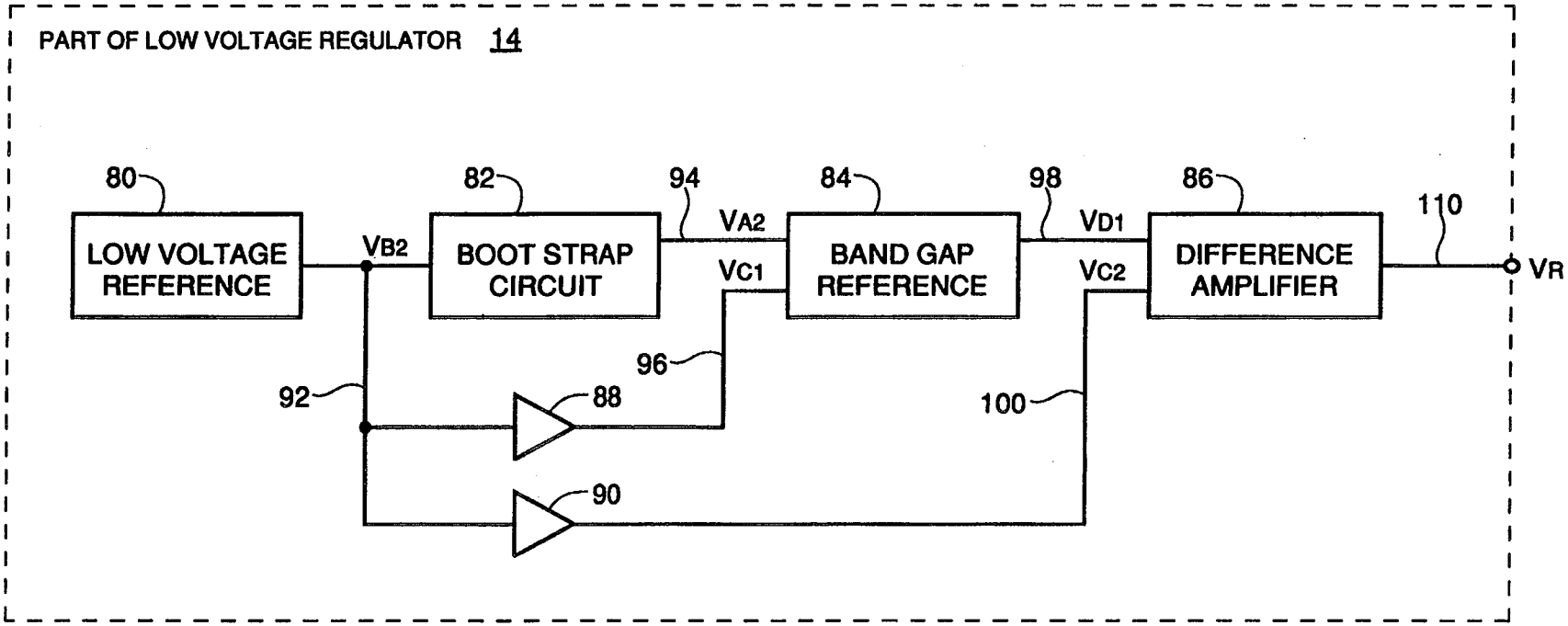
FIG. 2 is a functional block diagram of a portion of the low voltage regulator shown in FIG. 1.

FIG. 2 is a block diagram of a portion of the low voltage regulator shown in FIG. 1. The output of the portion shown is signal VR on line 110. Signal VR is included in intermediate power signals 50 shown on FIG. 1. Signal VR is generated in part responsive to the output of a low voltage reference.

Low voltage reference 80 provides voltage signal VB2 for biasing bootstrap circuit 82. In response to signal VB2, bootstrap circuit 82 provides signal VA2 on line 94. Signal VB2 is also conveyed on line 92 to amplifiers 88 and 90.

Each amplifier 88 and 90 provides an output voltage signal, VC1 and VC2 respectively, so that loading on line 96 is independent of loading on line 100. Signals coupled onto line 96 do not affect signals on line 100, and vice versa. This independence is a consequence of buffering signal VB2 through two separate amplifiers. Amplifiers 88 and 90 have unity gain. In one embodiment, amplifiers 88 and 90 are identical in circuitry, gain, and layout so that signals VC1 and VC2 have the same voltage magnitude. In another embodiment, the respective gains of amplifiers 88 and 90 are other than unity. In still another embodiment, appropriate design choices are exercised in bandgap reference 84 and difference amplifier 86 when the gains of amplifiers 88 and 90 do not match.

Signals VA2 and VC1 are coupled on lines 94 and 96, respectively, to the inputs of a summing circuit. In the embodiment shown, band gap reference 84 is a summing circuit that provides signal VD1 on line 98 responsive to the sum of the voltage of signals VA2 and VC1 and feedback signals (internal to the band gap reference) not shown. As will become more apparent in the description that follows, band gap reference 84 includes a difference amplifier having inputs responsive to feedback from the difference amplifier output. Signal VA2 is coupled to one of the difference amplifier inputs so that signal VD1 does not remain at zero following application of VCCX. Signal VC1 is coupled to both inputs of the difference amplifier to bias feedback signals near ground potential. The design and operation of a band gap reference circuit is well known in the art and will be described in more detail with reference to FIG. 3.

The output of band gap reference 84, signal VD1, on line 98 and the output of amplifier 90, signal VC2, on line 100 are coupled to difference amplifier 86 for subtraction. The voltage of output signal VR on line 110 corresponds to the algebraic difference between the voltages on lines 98 and 100. The effect of coupling signal VC1 to all inputs of the difference amplifier within band gap reference 84 is counteracted by the effect of subtracting signal VC2 from the output of band gap reference 84. Therefore, signal VR corresponds to the sum of the feedback signals within band gap reference 84. Difference amplifier 86 in one embodiment has unity gain. When, in other embodiments, a voltage signal VR of another magnitude is used by circuit 30, difference amplifier 86 has other than unity gain.

Figure 3:
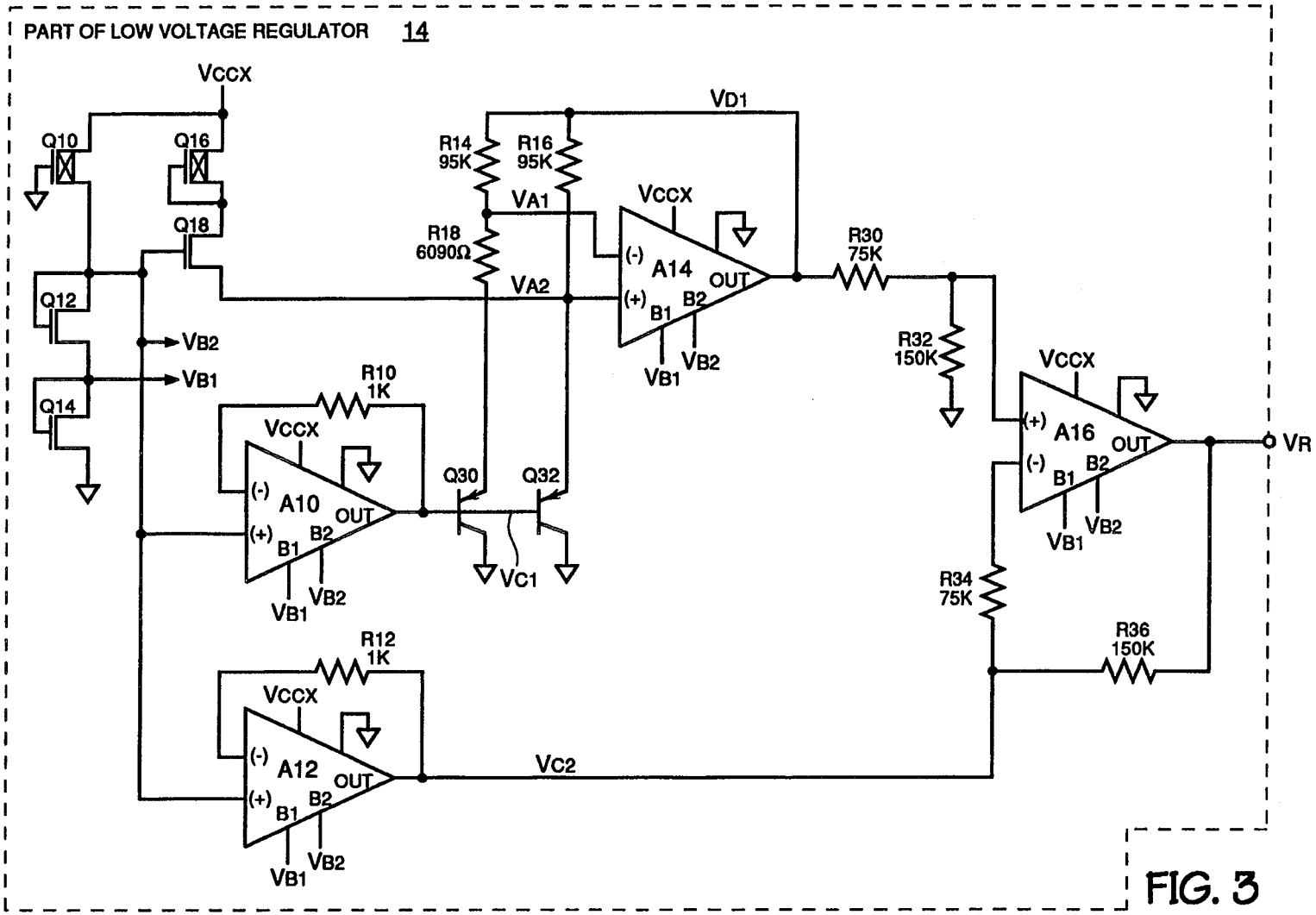
FIG. 3 is a schematic diagram of one implementation of the block diagram shown in FIG. 2.

FIG. 3 is a schematic diagram of one implementation of the block diagram shown in FIG. 2. Transistors Q10 through Q14 supply two reference voltages: VB1 of about 0.7 volts and VB2 of about 1.4 volts. Signals VB1 and VB2 are coupled to the four difference amplifiers A10 through A16 to uniformly control bias currents therein.

Transistors Q16 and Q18 cooperate to provide means for selectively combining a reference signal with a feedback signal supplied through R16 to amplifier A14 (+) input. Transistor Q16 is connected to operate as a first source, defining a reference voltage signal at the node between Q16 and Q18. Q16 operates as a current limiting series resistance between VCCX and amplifier A14 (+) input. Current supplied through Q16 flows through series control transistor Q18.

Transistor Q18 is "on" from the time power is applied and transistor Q10 conducts, to the time that amplifier A14 provides a feedback signal sufficient to turn transistor Q18 "off." In this embodiment, the gate of transistor Q18 is a control element. A bipolar transistor is equivalently used in an alternate embodiment, not shown. The control element of a bipolar transistor can be the base, or in some circuits, the emitter. When transistor Q18 is off, the reference voltage signal is no longer available to combine with or control the voltage of signal VA2. Other embodiments of a means for selectively combining depend on the nature of the reference voltage signal. In the embodiment shown, VA2 is essentially a direct current signal. In alternate and equivalent embodiments, signal properties other than voltage magnitude constitute reference signal VA2. For example, where signal VA2 has additional frequency components, the mechanism for selectively combining includes switching circuits, attenuation circuits, limiting circuits, reference source control circuits, and the like.

Reference voltage signal VB2 is buffered by amplifiers A10 and A12, configured for unity gain. At a voltage of 1.4 volts, signal VB2 falls within the input voltage range of amplifiers A10 and A12, so the respective output voltage signals VC1 and VC2 have a magnitude of 1.4 volts.

Amplifier A14 has two summing junctions. The first, connected to amplifier A14 (−) input, conveys signal VA1, generated in part by a first voltage divider. Resistors R14, R18, and transistor Q30 form a voltage divider coupled to amplifier A14 output. A portion of the voltage at the output of amplifier A14 is fed back through R14 to the summing junction. Signal VC1, supplied to the base of transistor Q30, raises the potential at the emitter of Q30 above the voltage drop of a P-N junction, typically 0.7 volts for silicon transistors. Semiconducting materials, including gallium arsenide and germanium, each have a characteristic diode forward voltage drop, typically less than a volt.

The difference between the voltage of signal VA1 and the voltage at the emitter of transistor Q30 causes a current through resistor R18 out of the first summing junction. Hence, signal VB2 is combined with the feedback signal through resistor R14 to form signal VA1.

The second summing junction combines three signals. The current supplied through transistor Q18, is combined with a feedback current (supplied by amplifier A14 output through resistor R16) and a current through transistor Q32. The voltage at the output of amplifier A14 responds to the algebraic sum of the voltages at the two summing nodes.

Amplifier A14 sums the signals at its inputs to provide an output sum signal. Because amplifier A14 has an inverting input, the (−) input, the output voltage will correspond to the voltage of signal VA2 plus the inverse of the voltage of signal VA1. In other words, the output voltage is proportional to VA2 minus VA1. This relationship between input and output voltages holds while the voltage of signals VA1 and VA2 are within the input voltage range of amplifier A14. The voltage of signal VA2 will be about 2.1 volts, which is within the input voltage range of amplifier A14, as will be discussed with reference to FIG. 4.

The circuitry associated with amplifier A14 bears some resemblance to the circuitry of a conventional band gap reference circuit. However, amplifier A14 is powered between a single voltage source and ground and the reference base-emitter junctions are biased up from ground by signal VC1. These differences do not adversely affect the temperature stability characteristics of the output signal from amplifier A14 in this embodiment in part because buffer amplifier A10 and amplifier A14 are identical in construction and layout, and in part because amplifiers A10 and A14 have bias currents controlled from a common control signal VB2. To insure temperature stability, transistor Q30 has a die layout about ten times the layout of transistor Q32.

By coupling the output of amplifier A10 to transistors Q30 and Q32, signal VC1 is combined with the feedback signals input to amplifier A14. The output voltage of amplifier A14 is, thereby, responsive to the magnitude of the voltage of signal VC1 as already discussed. Therefore, to provide an output voltage VR that corresponds exclusively to the sum of the feedback signals, the magnitude of the voltage of signal VC2 is subtracted from the signal output from amplifier A14 by difference amplifier A16.

Amplifier A16 provides signal VR having a voltage corresponding to the difference between the voltage of signals VD1 and VC2; the difference multiplied, in this embodiment, by a gain of two. The voltage of signal VD1 in one embodiment is 1.65 volts (corresponding to the band gap voltage) plus the voltage of VC1, about 1.4 volts. The result of the subtraction and the gain of two provides signal VR with a voltage of 3.3 volts for powering circuit 30 directly or through primary regulators 20 shown on FIG. 1. Digital integrated circuits conventionally operate at a voltage about 5 volts. The present invention finds application in digital integrated circuitry where VR is less than 10 volts; however, apparatus and methods of the present invention are not limited by a maximum voltage.

Amplifiers A10 through A16 are shown in FIG. 3 using the operational amplifier symbol. In one embodiment of integrated circuit 10 such as a DRAM, the function of an operational amplifier (the ability to form the algebraic sum of input signals) is accomplished with simple circuitry, such as the difference amplifier circuit shown in FIG. 4.

Figure 4:
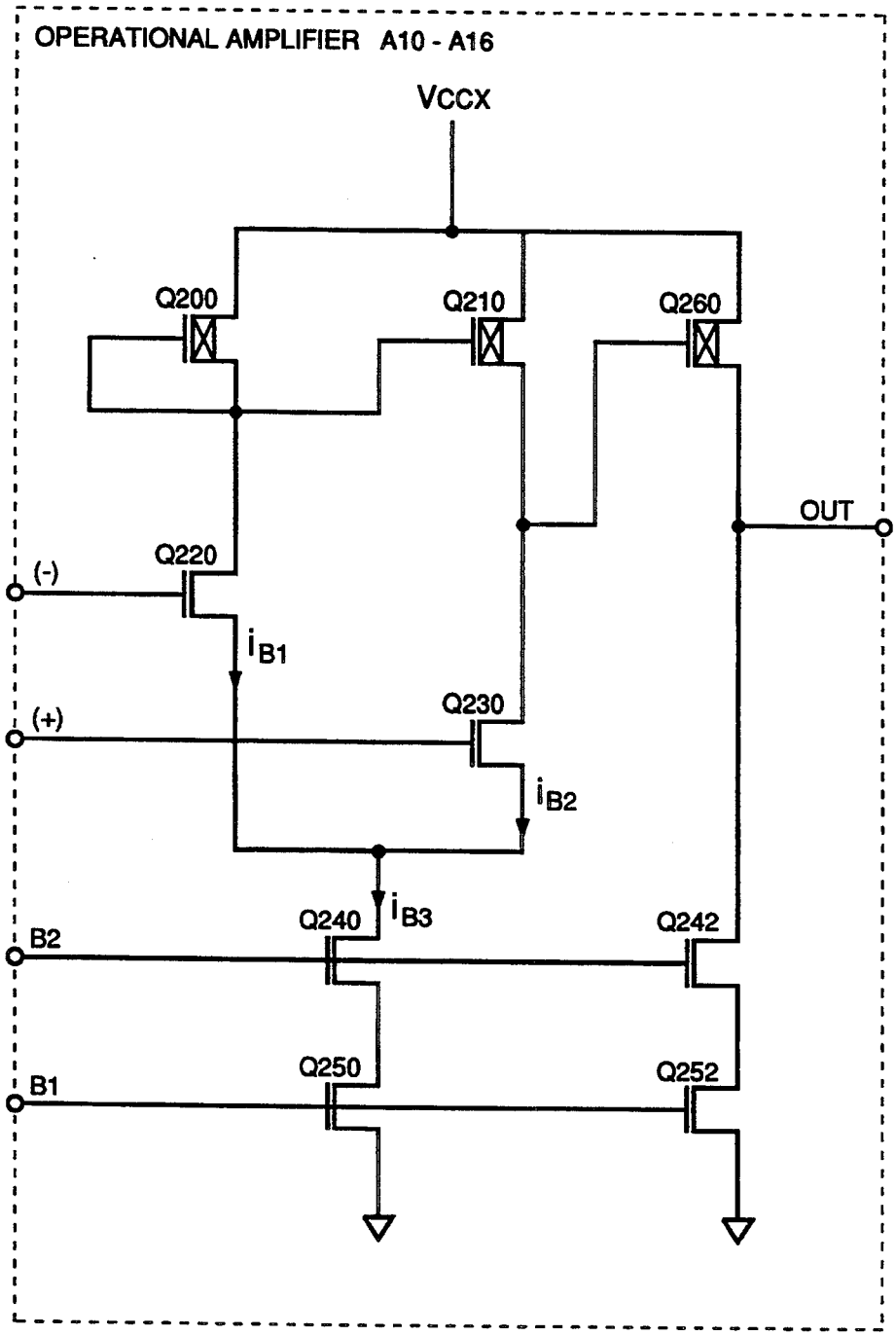
FIG. 4 is a schematic diagram of a difference amplifier shown as an operational amplifier in FIG. 3.

FIG. 4 is a schematic diagram of a difference amplifier shown as an operational amplifier in FIG. 3. Transistors Q240 and Q250 are in cascode arrangement to provide a high impedance current mirror. Bias current $i_{B3}$ (the sum of currents $i_{B1}$ and $i_{B2}$) is conducted by the current mirror and controlled by signals B2 and B1. In operation, a current mirror conducts current of a magnitude proportional to the current in a similar arrangement of transistors located elsewhere in the integrated circuit. In the embodiment shown in FIG. 3, the current conducted through transistors Q12 and Q14 is "mirrored" by the current conducted through transistors corresponding to Q240 and Q250 in each amplifier A10 through A16. Transistors included in a current mirror conventionally have matching $V_T$ and $g_m$ characteristics. In the embodiment shown, transistors corresponding to transistors Q240 and Q250 in each amplifier A10 through A16 match transistors Q12 and Q14 in $V_T$, $g_m$, size, and layout.

Amplifier A16 and resistors R30 through R36 provide means for subtracting input signals to provide an output difference signal. The form of the means for subtracting depends on the nature of the signals to be subtracted and the resulting difference signal. Although voltage magnitudes convey signal meaning in the circuitry described above, current magnitudes in an alternate embodiment are equivalent, and signals having additional frequency components are equivalent. Circuits that provide a subtraction function include passive component networks, tuning circuits, demodulators, comparators, differential amplifiers, summing circuits, and the like.

Figure 5:
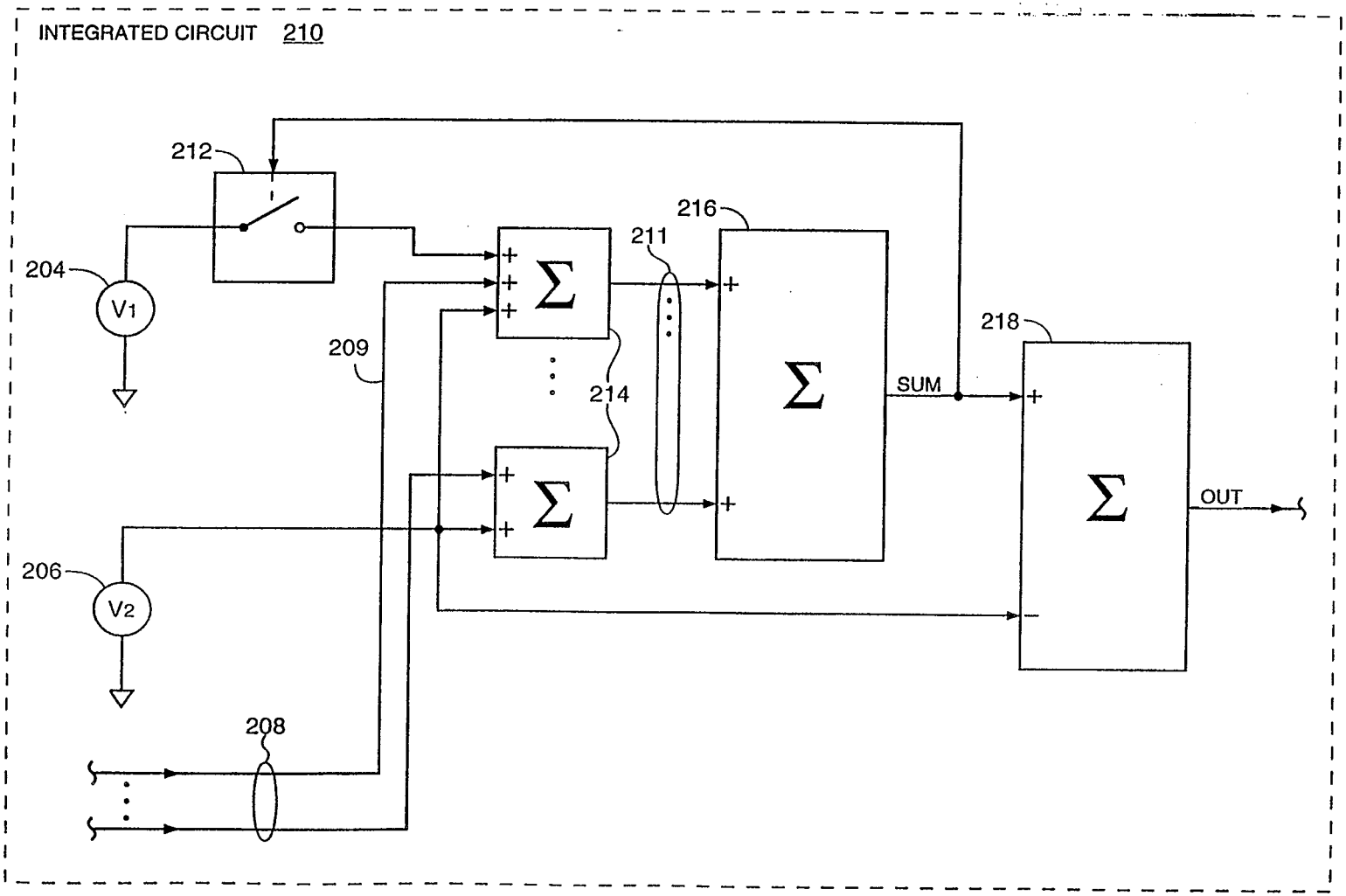
FIG. 5 is a functional block diagram of an integrated circuit in another embodiment of the present invention.

FIG. 5 is a functional block diagram of an integrated circuit in another embodiment of the present invention. Integrated circuit 210 includes summing circuit 216, a source 204 for signal V1, a source 206 for signal V2, circuits 214 for combining signals prior to summation by summing circuit 216, and subtraction circuit 218. Summing circuit 216 has a plurality of inputs 211 for a group of input signals 208. In operation, circuit 216 provides signal SUM corresponding to the sum of signals 211. Switch 212 and one of circuits 214 cooperate as means for selectively combining signal V1 with one input signal 209. Circuits 214 cooperate to combine signal V2 with each input signal of the group 208, thus, biasing every input signal so that it is within the allowable input signal range so that output signal SLIM is valid. Subtraction circuit 218 is a summation circuit having an inverting input. By subtracting signal V2 from signal SUM, the bias is removed from output signal OUT.

The foregoing description discusses preferred embodiments of the present invention, which may be changed or modified without departing from the scope of the present invention.

For example, P-channel FETs discussed above may be replaced with N-channel FETs (and vice versa) in some applications with appropriate polarity changes in controlling signals as required. Moreover, the P-channel and N-channel FETs discussed above generally represent active devices which may be replaced with bipolar or other technology active devices. These and other changes and modifications known to those skilled in the art are intended to be included within the scope of the present invention.

While for the sake of clarity and ease of description, several specific embodiments of the invention have been described; the scope of the invention is intended to be measured by the claims as set forth below. The description is not intended to be exhaustive or to limit the invention to the form disclosed. Other embodiments of the invention will be apparent in light of the disclosure to one of ordinary skill in the art to which the invention applies.

The words and phrases used in the claims are intended to be broadly construed. An "integrated circuit" refers generally to electrical apparatus and includes but is not limited to a packaged integrated circuit, an unpackaged integrated circuit, a wafer, a combination of packaged or unpackaged integrated circuits or both, a microprocessor, a microcontroller, a memory, a logic device, a charge-coupled device, combinations thereof, and equivalents.

A "signal" refers to electromagnetic energy conveying information. When elements are coupled, a signal can be conveyed in any manner feasible in light of the nature of the coupling. For example, if several electrical conductors couple two elements, then the relevant signal comprises the energy on one, some, or all conductors at a given time or time period. When a physical property of a signal has a quantitative measure and the property is used by design to control or communicate information, then the signal is said to be characterized by having a value or magnitude.

What is claimed is:

1. An integrated circuit comprising a first circuit for providing a first signal and a second circuit coupled to the first circuit and responsive to the first signal, the first circuit comprising:

a. a summing circuit responsive to a plurality of input signals for providing a sum signal corresponding to the sum of the input signals;

b. a first source, providing a first reference signal;

c. means, coupled to the first source and to the summing circuit, for selectively combining the first reference signal with at least one input signal;

d. a second source, providing a second reference signal, coupled to the summing circuit for combining the second reference signal with each input signal of the plurality; and e. means, coupled to the summing circuit and to the second source, for subtracting the second reference signal from the sum signal to provide the first signal.

2. The integrated circuit of claim 1 wherein the second circuit comprises a memory.

3. The integrated circuit of claim 2 wherein the memory comprises an array of dynamic memory cells.

4. The integrated circuit of claim 3 wherein the memory comprises means for serial access.

5. The integrated circuit of claim 1 wherein the first signal powers the second circuit.

6. The integrated circuit of claim 5 wherein the voltage of the first signal is less than 10 volts.

7. The integrated circuit of claim 1 wherein the summing circuit further comprises an inverting input.

8. The integrated circuit of claim 7 wherein the first circuit further comprises a first feedback circuit for coupling a portion of the sum signal to the inverting input.

9. The integrated circuit of claim 8 wherein the first circuit further comprises a feedback circuit for coupling a portion of the sum signal to an input signal of the plurality.

10. The integrated circuit of claim 9 wherein:

a. the first feedback circuit comprises a first transistor having an emitter coupled to the summing circuit and a base coupled to the second source; and b. the second feedback circuit comprises a second transistor having an emitter coupled to the summing circuit and a base coupled to the second source.

11. The integrated circuit of claim 1 wherein:

a. the integrated circuit comprises a semiconducting material;

b. the summing circuit comprises a difference amplifier comprising difference amplifier inputs responsive to the plurality of input signals; and c. the difference amplifier provides a sum signal when each of the plurality of input signals has a voltage to ground greater than one P-N junction forward voltage drop, characteristic of the material.

12. The integrated circuit of claim 1 wherein the first circuit further comprises an amplifier.

13. The integrated circuit of claim 12 wherein the amplifier comprises a current mirror.

14. The integrated circuit of claim 13 wherein the second source is coupled to the current mirror for controlling an amplifier bias current.

15. The integrated circuit of claim 1 wherein:

a. the summing circuit comprises a first amplifier coupled to the second source to receive a bias signal; and b. the means for subtracting comprises a second amplifier coupled to the second source to receive the bias signal.

16. The integrated circuit of claim 1 wherein the means for selectively combining comprises a transistor coupled in series between the first source and the summing circuit, the transistor comprising a control element responsive to a control signal for selectively coupling the first source to the summing circuit.

17. The integrated circuit of claim 16 wherein the second source is coupled to the control element to provide the control signal.

18. A method for summing signals, the method comprising the steps of:

a. coupling a first signal source to an input of a circuit comprising a plurality of inputs and an output, each input for receiving an input signal, the first signal being combined with at least one input signal, the output providing a sum signal corresponding to the sum of the first signal and the input signals;

b. decoupling the first signal source from the input after the sum signal is provided;

c. coupling a second signal source to the plurality of inputs so that the second signal is combined with each input signal; and d. subtracting the second signal from the sum signal so that the sum signal corresponds to the sum of the input signals.

19. The method of claim 18 wherein:

a. the step of coupling a first signal source to an input of a circuit further comprises the step of coupling the first signal source to a first difference amplifier;

b. the step of subtracting is performed by a second difference amplifier; and c. the method further comprises the step of biasing the first and the second difference amplifier with the second signal.

* * * * *